US010268146B2

(12) United States Patent
Sato et al.

(10) Patent No.: US 10,268,146 B2
(45) Date of Patent: Apr. 23, 2019

(54) FIXING DEVICE AND IMAGE FORMING APPARATUS

(71) Applicant: FUJI XEROX CO., LTD., Tokyo (JP)

(72) Inventors: Takaaki Sato, Kanagawa (JP); Kiyoshi Koyanagi, Kanagawa (JP); Toru Inoue, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/803,843

(22) Filed: Nov. 6, 2017

(65) Prior Publication Data

US 2018/0373186 A1 Dec. 27, 2018

(30) Foreign Application Priority Data

Jun. 22, 2017 (JP) ..... 2017-122280

(51) Int. Cl.
*G03G 15/20* (2006.01)

(52) U.S. Cl.
CPC ..... *G03G 15/2053* (2013.01); *G03G 15/2017* (2013.01); *G03G 15/2039* (2013.01)

(58) Field of Classification Search
CPC ..... G03G 15/2053; G03G 15/2017; G03G 15/2039
See application file for complete search history.

(56) References Cited

U.S. PATENT DOCUMENTS

2015/0139708 A1* 5/2015 Shimura ..... G03G 15/2042 399/329
2016/0098001 A1* 4/2016 Ogawa ..... G03G 15/2053 399/338

FOREIGN PATENT DOCUMENTS

JP 2003-257592 9/2003
JP 2016-161849 9/2016

* cited by examiner

*Primary Examiner* — Rodney A Bonnette
(74) *Attorney, Agent, or Firm* — JCIPRNET

(57) ABSTRACT

A fixing device includes a contact member that comes into contact with a recording medium on which an image is formed, a heater that has a contact-member facing surface, which faces the contact member, and a back surface, the heater heating the contact member, a heat supply member disposed in contact with the back surface of the heater, and supplying heat of a portion of the heater having a high temperature to a portion of the heater having a low temperature, and a heat transfer portion disposed in contact with the contact member, and having a flat contact surface that comes into contact with the contact member, the heat transfer portion transferring heat of the heat supply member to the contact member.

14 Claims, 10 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2017-122280 filed Jun. 22, 2017.

BACKGROUND

Technical Field

The present invention relates to a fixing device and an image forming apparatus.

SUMMARY

A fixing device according to an aspect of the invention includes a contact member that comes into contact with a recording medium on which an image is formed, a heater that has a contact-member facing surface, which faces the contact member, and a back surface, the heater heating the contact member, a heat supply member disposed in contact with the back surface of the heater and supplying heat of a portion of the heater having a high temperature to a portion of the heater having a low temperature, and a heat transfer portion disposed in contact with the contact member and having a flat contact surface that comes into contact with the contact member, the heat transfer portion transferring heat of the heat supply member to the contact member.

BRIEF DESCRIPTION OF THE DRAWINGS

Exemplary embodiments of the present invention will be described in detail based on the following figures, wherein.

DETAILED DESCRIPTION

Now, exemplary embodiments of the present invention are described below with reference to the appended drawings.

Figure 1:
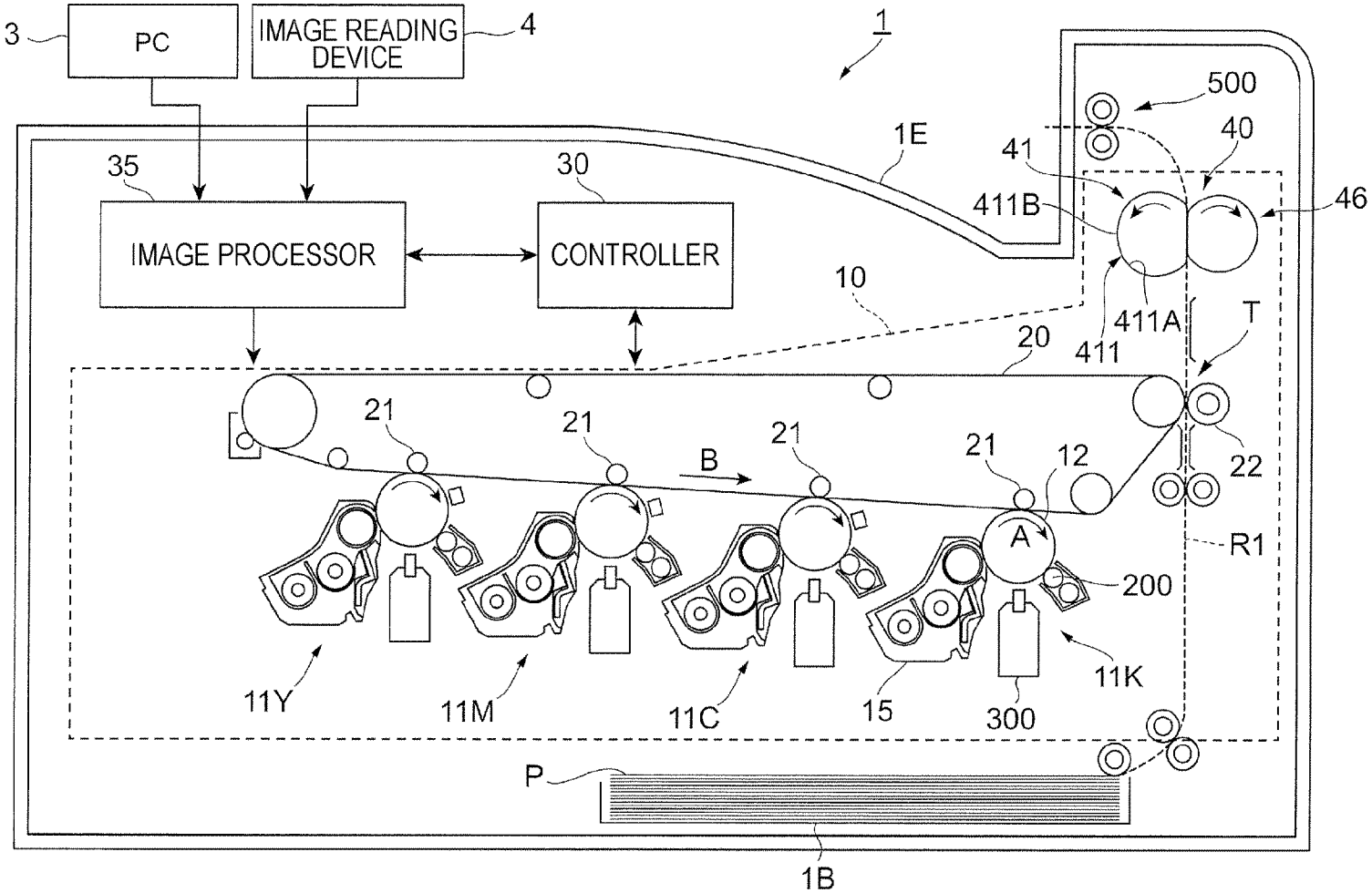
FIG. 1 illustrates a general structure of an image forming apparatus.

FIG. 1 is a general structure of an image forming apparatus 1.

The image forming apparatus 1 is a tandem color printer.

The image forming apparatus 1 includes an image forming portion 10, serving as an example of an image forming device. The image forming portion 10 forms images on sheets P, which are an example of a recording medium, on the basis of image data of different colors.

The image forming apparatus 1 also includes a controller 30 and an image processor 35.

The controller 30 controls functional portions of the image forming apparatus 1.

The image processor 35 performs image processing on image data from devices such as a personal computer (PC) 3 or an image reading device 4.

The image forming portion 10 includes four image forming units 11Y, 11M, 11C, and 11K (hereinafter collectively and simply referred to as "image forming units 11") arranged side by side at constant intervals.

The image forming units 11 have the same structure, except for toners stored in developing devices 15 (described below). Each image forming unit 11 forms toner images (images) of yellow (Y), magenta (M), cyan (C), or black (K).

Each image forming unit 11 includes a photoconductor drum 12, a charging device 200, which charges the photoconductor drum 12, and an LED print head (LPH) 300, which exposes the photoconductor drum 12 to light.

The photoconductor drum 12 is charged by the charging device 200. The photoconductor drum 12 is also exposed to light by the LPH 300 to have an electrostatic latent image formed thereon.

Each image forming unit 11 also includes a developing device 15, which develops an electrostatic latent image formed on the photoconductor drum 12, and a cleaner (not illustrated) that cleans the surface of the photoconductor drum 12.

The image forming portion 10 also includes an intermediate transfer belt 20 to which toner images of different colors formed by the photoconductor drums 12 are transferred, and first transfer rollers 21, which sequentially transfer (first-transfer) toner images of different colors formed by the photoconductor drums 12 to the intermediate transfer belt 20.

The image forming portion 10 also includes a second transfer roller 22, which collectively transfers (second-transfers) toner images transferred to the intermediate transfer belt 20 to a sheet P, and a fixing device 40, which fixes toner images transferred to a sheet P to the sheet P.

The fixing device 40 includes a fixing belt module 41, which includes a heater, and a pressing roller 46.

The fixing belt module 41 is disposed to the left of a sheet transport path R1 in the drawing. The pressing roller 46 is disposed to the right of the sheet transport path R1 in the drawing. The pressing roller 46 is pressed against the fixing belt module 41.

The fixing belt module 41 includes a film-like fixing belt 411, which comes into contact with the sheet P.

The fixing belt 411, which is an example of a contact member, includes, for example, a mold releasing layer located as an outermost layer to come into contact with the sheet P, an elastic layer located on the inner side of the mold releasing layer, and a base layer that supports the elastic layer.

The fixing belt 411 is endless and rotates in the counterclockwise direction in the drawing. A lubricant is applied to an inner peripheral surface 411A of the fixing belt 411 to reduce resistance of the fixing belt 411 caused when the fixing belt 411 slides over components such as a heater, described below. Examples used as a lubricant include a liquid oil, such as a silicone oil or a fluorine oil, grease obtained by mixing a solid object and a liquid, and a combination of a liquid oil and grease.

The fixing belt 411 comes into contact with a sheet P transported from the lower side in the drawing. A portion of the fixing belt 411 that comes into contact with the sheet P moves together with the sheet P. The fixing belt 411 then holds the sheet P together with the pressing roller 46 between the fixing belt 411 and the pressing roller 46 and presses and heats the sheet P.

The fixing belt module 41 includes a heater (described below) that heats the fixing belt 411 on the inner side of the fixing belt 411.

The pressing roller 46, which is an example of a pressing member, is disposed to the right side of the sheet transport path R1 in the drawing. The pressing roller 46 is pressed against an outer peripheral surface 411B of the fixing belt 411 and presses the sheet P (sheet P that passes along the sheet transport path R1) that passes between the fixing belt 411 and the pressing roller 46.

The pressing roller 46 is rotated by a motor (not illustrated) in the clockwise direction in the drawing. When the pressing roller 46 rotates in the clockwise direction, the fixing belt 411 receives a driving force from the pressing roller 46 and rotates in the counterclockwise direction.

The image processor 35 of the image forming apparatus 1 performs image processing on image data from the PC 3 or the image reading device 4, and transmits image data subjected to image processing to each image forming unit 11.

For example, in the image forming unit 11K for black (K), the photoconductor drum 12 is charged by the charging device 200 while rotating in the direction of arrow A, and exposed by the LPH 300 to light based on the image data transmitted from the image processor 35.

Thus, an electrostatic latent image corresponding to an image for black (K) is formed on the photoconductor drum 12. The electrostatic latent image formed on the photoconductor drum 12 is developed by the developing device 15, so that a toner image for black (K) is formed on the photoconductor drum 12.

Similarly, toner images for the colors of yellow (Y), magenta (M), and cyan (C) are respectively formed on the image forming units 11Y, 11M, and 11C.

The first transfer rollers 21 sequentially cause toner images for respective colors formed by the image forming units 11 to electrostatically adhere to the intermediate transfer belt 20 that moves in the direction of arrow B. Thus, toner images in which different color toners are superposed one on another are formed on the intermediate transfer belt 20.

The toner images formed on the intermediate transfer belt 20 are transported with the movement of the intermediate transfer belt 20 to a portion at which the second transfer roller 22 is located (second transfer portion T). At the timing when the toner images arrive at the second transfer portion T, a sheet P is fed from a sheet storage 1B to the second transfer portion T.

At the second transfer portion T, the transfer electric field formed by the second transfer roller 22 collectively and electrostatically transfers the toner images on the intermediate transfer belt 20 to the sheet P transported thereto.

Thereafter, the sheet P to which the toner images have been electrostatically transferred is released from the intermediate transfer belt 20 and transported to the fixing device 40.

In the fixing device 40, the fixing belt module 41 and the pressing roller 46 hold the sheet P therebetween. Specifically, the fixing belt 411 that rotates in the counterclockwise direction and the pressing roller 46 that rotates in the clockwise direction hold the sheet P therebetween.

Thus, the sheet P is pressed and heated to fix the toner images on the sheet P to the sheet P. The sheet P subjected to the fixing is transported to a sheet receiving portion 1E by discharging rollers 500.

Figure 2B:
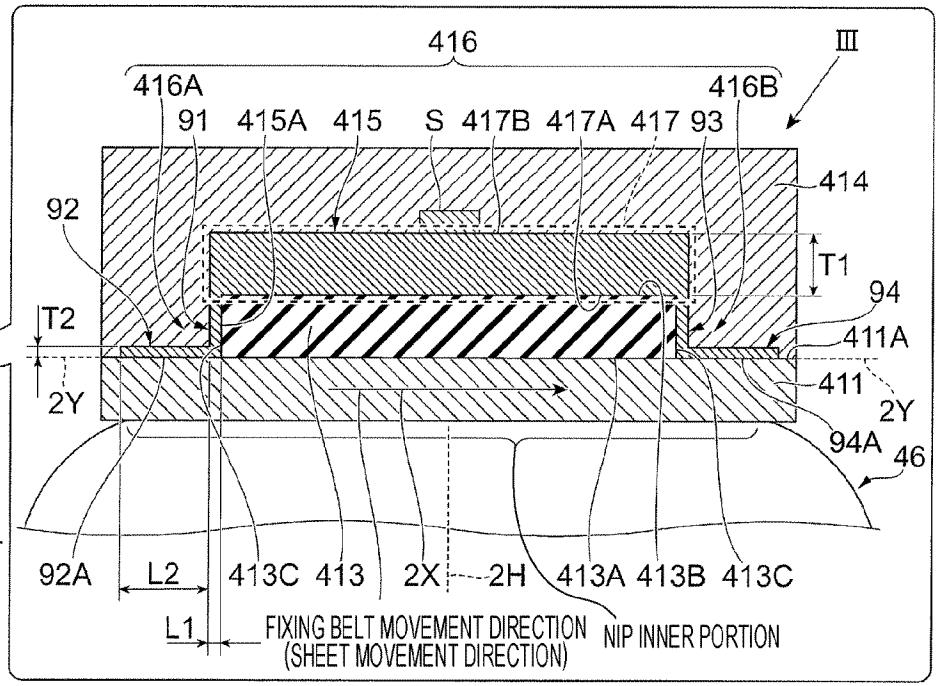
FIGS. 2A, 2B, and 2C illustrate a structure of a fixing device.
Figure 2A:
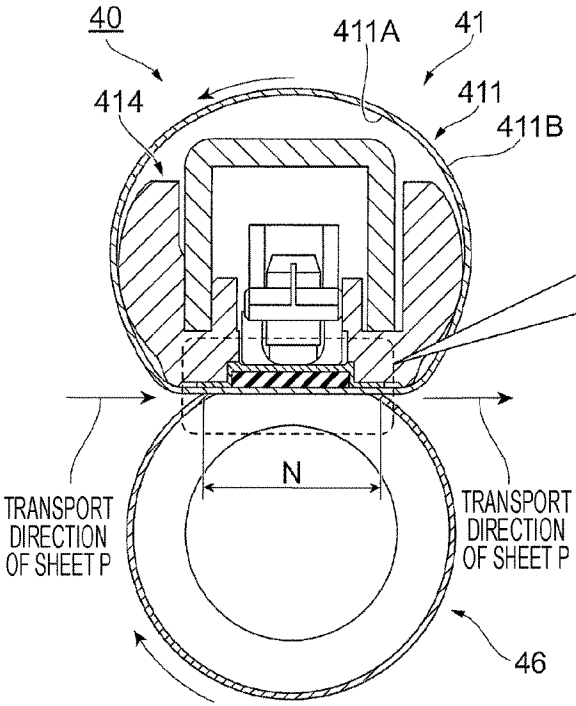
Figure 2C:
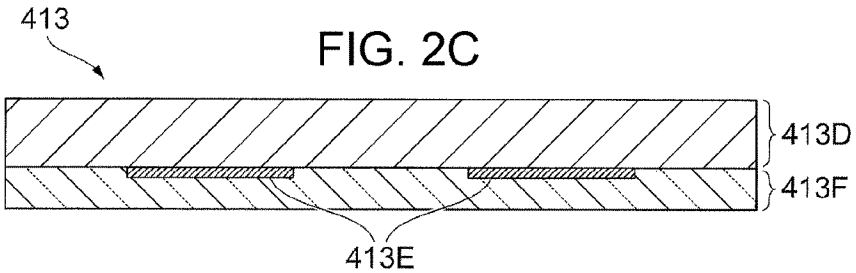

FIGS. 2A, 2B, and 2C illustrate the structure of the fixing device 40.

As illustrated in FIG. 2A, the fixing device 40 includes the fixing belt module 41 and the pressing roller 46.

The fixing belt module 41 includes a fixing belt 411 used to fix the toner image to the sheet P. The fixing belt 411 is pressed against the surface of the sheet P on which the toner images are formed.

The pressing roller 46, which is an example of a pressing member, is pressed against the outer peripheral surface 411B of the fixing belt 411 to press the sheet P that passes between the fixing belt 411 and the pressing roller 46.

Specifically, the pressing roller 46 is disposed in contact with the outer peripheral surface 411B of the fixing belt 411 and forms, between itself and the fixing belt 411, a nip portion N (an example of a pressing area), through which the sheet P passes while being pressed.

In the exemplary embodiment, the sheet P is heated and pressed while passing through the nip portion N to fix the toner image to the sheet P.

As illustrated in FIG. 2B, a heater 413 that heats the fixing belt 411 is disposed on the inner side of the fixing belt 411.

The heater 413 has a plate shape that extends in the width direction of the fixing belt 411 and the direction in which the fixing belt 411 moves. The heater 413 has a contact-member facing surface 413A, which faces (comes into contact with) the fixing belt 411, and a back surface 413B, which is disposed to the side opposite to the contact-member facing surface 413A. The heater 413 also has two side surfaces 413C, connecting the contact-member facing surface 413A and the back surface 413B to each other.

In the present exemplary embodiment, the heater 413 supplies heat to the fixing belt 411 to heat the fixing belt 411. In the present exemplary embodiment, the pressing roller 46 is pressed against the contact-member facing surface 413A of the heater 413 with the fixing belt 411 interposed therebetween.

As illustrated in FIG. 2C, the heater 413 includes a plate-shaped base layer 413D and heat generating layers 413E, which are disposed on the surface of the base layer 413D (surface closer to the fixing belt 411) and extend in the direction perpendicular to the plane of FIGS. 2A, 2B, and 2C.

The heater 413 also includes a protective layer 413F, which has insulating properties and covers the heat generating layers 413E. The protective layer 413F is made of, for example, fired glass.

As illustrated in FIGS. 2A and 2B, a support member 414, which supports the heater 413, is disposed on the inner side of the fixing belt 411 and over the back surface 413B of the heater 413.

A heat transfer member 415 is interposed between the back surface 413B of the heater 413 and the support member 414.

The heat transfer member 415 receives heat from the heater 413.

Figure 3:
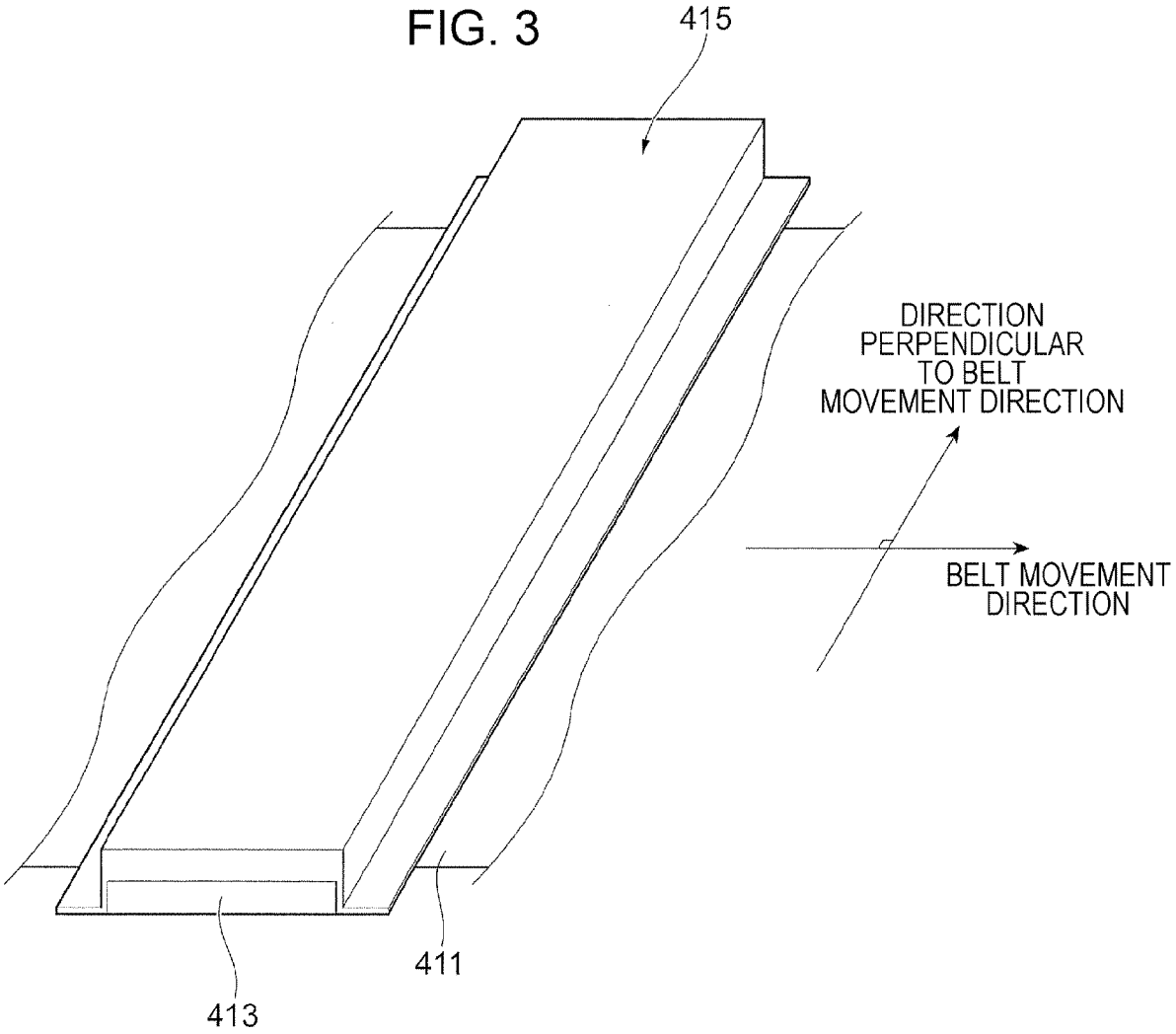
FIG. 3 is a perspective view of components including a heat transfer member viewed in a direction of arrow III in FIGS. 2A, 2B, and 2C.

As illustrated in FIG. 3 (perspective view when components such as the heat transfer member 415 are viewed in the direction of arrow III in FIG. 2B), the heat transfer member 415 is long and extends in the direction perpendicular to the belt movement direction in which the fixing belt 411 moves. In other words, the heat transfer member 415 is disposed so as to extend in the width direction of the fixing belt 411.

The heat transfer member 415 supplies heat of a hot portion of the heater 413 to a cool portion of the heater 413.

When the sheet P that is to be subjected to a fixing operation has a small width, both end portions of the heater 413 in the longitudinal direction (portions of the heater 413 that do not come into contact with the sheet P) have their temperature raised. In this case, the temperature of the heater 413 may become uneven so that a large-sized sheet P, when subjected to a fixing operation, may have fixing unevenness.

The heat transfer member 415, if provided, supplies heat of a hot portion of the heater 413 to a cool portion of the heater 413 to reduce the temperature variance in the heater 413.

As illustrated in FIG. 2B, the heat transfer member 415 according to the present exemplary embodiment includes heat transfer portions 416, each of which extends toward the fixing belt 411 to supply heat of the heat transfer member 415 to the fixing belt 411.

As illustrated in FIG. 2B, the heat transfer member 415 also has a recess 415A in the surface facing the fixing belt 411. In the present exemplary embodiment, the heater 413 is held in the recess 415A. In other words, the heat transfer member 415 has a groove extending in the longitudinal direction of the heat transfer member 415. The heater 413 is held in this groove.

In the structure in which the heater 413 is held in the recess 415A of the heat transfer member 415, the heater 413 is covered with the heat transfer member 415 except for the side on which the fixing belt 411 is located.

This structure reduces heat radiation from the heater 413 and the heat transfer member 415 facilitates recovery of heat from the heater 413, so that a larger amount of heat is supplied to the fixing belt 411 (described in detail, below).

As illustrated in FIG. 2B, the heat transfer member 415 includes a temperature-leveling portion 417 and the heat transfer portions 416.

The temperature-leveling portion 417, which is an example of a heat supply member and a heat receiving member, has a plate shape (has a rectangular section) and disposed in contact with the back surface 413B of the heater 413. The temperature-leveling portion 417 is disposed along the back surface 413B of the heater 413.

Here, the wording that the temperature-leveling portion 417 "comes into contact with" the back surface 413B is not limited to the form in which the temperature-leveling portion 417 directly comes into contact with the back surface 413B and includes the form in which the temperature-leveling portion 417 comes into contact with the back surface 413B with another component interposed therebetween.

The temperature-leveling portion 417 is disposed in the longitudinal direction of the heater 413 (in the direction perpendicular to the plane of the drawing).

The temperature-leveling portion 417 receives heat from the heater 413 and accumulates the heat. As described above, the temperature-leveling portion 417 supplies heat of a hot portion of the heater 413 to a cool portion of the heater 413. Thus, the temperature variance of the heater 413 is reduced, as described above.

The heat transfer portions 416 are connected to (disposed in contact with) the temperature-leveling portion 417 and the fixing belt 411 to transfer heat of the temperature-leveling portion 417 to the fixing belt 411.

The heat transfer portions 416 are made of metal such as aluminium, stainless steel, or copper and have high thermal conductivity. In the present exemplary embodiment, the temperature-leveling portion 417 and the heat transfer portions 416 are integrated together. The temperature-leveling portion 417 is also made of metal.

The present exemplary embodiment has been described using the case where the heat transfer member 415 is a single unit and the temperature-leveling portion 417 and the heat transfer portions 416 are integrated together. However, the temperature-leveling portion 417 and the heat transfer portions 416 may be formed from separate components and both may be connected together.

In the present exemplary embodiment, a temperature sensor S, which detects the temperature of the temperature-leveling portion 417, is disposed at a portion opposite to the temperature-leveling portion 417.

More specifically, the temperature-leveling portion 417 according to the present exemplary embodiment has a contact-member facing surface 417A, which faces the heater 413, and a back surface 417B. In the present exemplary embodiment, a temperature sensor S is disposed at a portion facing the back surface 417B.

The detection results from the temperature sensor S are output to the controller 30 (see FIG. 1) and the controller 30 controls the heater 413 on the basis of the detection results.

Figure 4:
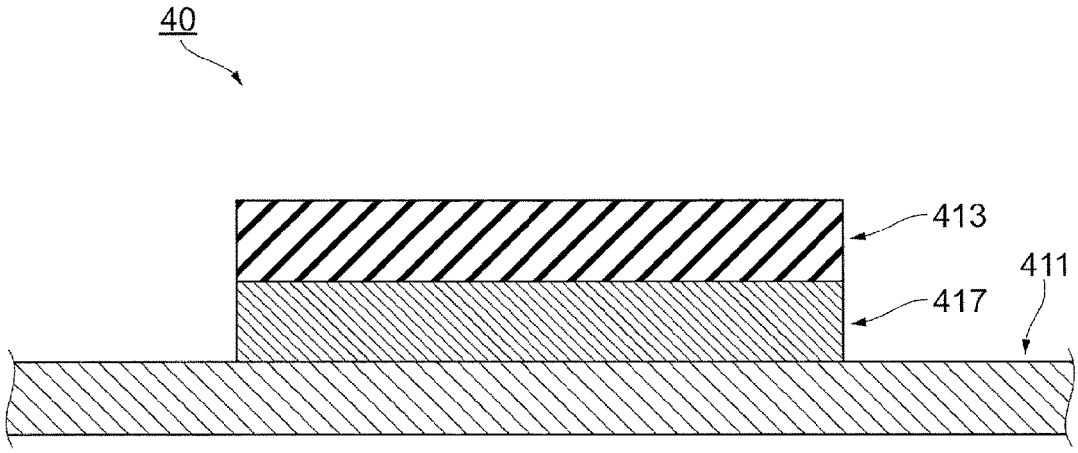
FIG. 4 illustrates a comparative example of a fixing device.

FIG. 4 illustrates a comparative example of the fixing device 40. FIG. 4 illustrates only the heater 413, the temperature-leveling portion 417, and the fixing belt 411 of the fixing device 40.

In this comparative example, the temperature-leveling portion 417 is interposed between the heater 413 and the fixing belt 411. In this comparative example, the temperature-leveling portion 417 reduces the temperature variance in the fixing belt 411.

Specifically, heat of a hot portion of the fixing belt 411 is supplied to a cool portion of the fixing belt 411 through the temperature-leveling portion 417 to reduce the temperature variance in the fixing belt 411.

In this comparative example, it takes a long time for the heater 413 to be ready to perform the fixing operation (hereinafter the time is referred to as "start-up time") after the heater 413 is turned on.

In this comparative example, the temperature-leveling portion 417 is interposed between the heater 413 and the fixing belt 411. This structure hinders heat generated at the heater 413 from arriving at the fixing belt 411 and thus from raising the temperature of the fixing belt 411. This structure thus elongates the start-up time.

On the other hand, the structure according to the present exemplary embodiment illustrated in FIGS. 2A, 2B, and 2C does not have the temperature-leveling portion 417 interposed between the heater 413 and the fixing belt 411.

This structure thus allows heat generated at the heater 413 to be easily transferred to the fixing belt 411 and facilitates the rise of the temperature of the fixing belt 411. Thus, the structure according to the present exemplary embodiment reduces the start-up time compared to that of the comparative example.

The structure according to the exemplary embodiment illustrated in FIGS. 2A, 2B, and 2C allows the heat transfer portions 416 to transfer heat of the temperature-leveling portion 417 to the fixing belt 411 and easily maintains the temperature of the fixing belt 411 during the fixing operation.

Specifically, during the fixing operation (while the sheets P are being successively fed to the fixing device 40), the fixing belt 411 is more likely to have its heat taken by the sheets P and is thus more likely to have its temperature lowered. According to the present exemplary embodiment, heat accumulated in the temperature-leveling portion 417 is supplied to the fixing belt 411 through the heat transfer portions 416.

Thus, the temperature of the fixing belt 411 is more easily maintained. This structure is capable of performing a fixing operation with less power than the structure that does not include the temperature-leveling portion 417.

The structure according to the present exemplary embodiment illustrated in FIGS. 2A, 2B, and 2C has higher flexibility in shaping of a component that comes into contact with the inner peripheral surface 411A of the fixing belt 411 than the structure according to the comparative example.

In the structure according to the present exemplary embodiment, the protective layer 413F (see FIG. 2C) of the heater 413 comes into contact with the inner peripheral surface 411A of the fixing belt 411. The protective layer 413F is made of fired glass and has high flexibility when being shaped.

On the other hand, in the structure according to the comparative example (structure illustrated in FIG. 4), the temperature-leveling portion 417 comes into contact with the fixing belt 411. The temperature-leveling portion 417 is typically made of metal, which requires cutting for being shaped and has low flexibility in shaping.

Still referring to FIGS. 2A, 2B, and 2C, the fixing device 40 of the present exemplary embodiment is further described.

As illustrated in FIG. 2B, the heat transfer portions 416 include an upstream heat transfer portion 416A, located on the upstream side in the movement direction of the fixing belt 411, and a downstream heat transfer portion 416B, located on the downstream side in the movement direction of the fixing belt 411.

Thus, in the present exemplary embodiment, heat from the temperature-leveling portion 417 is transferred to multiple portions of the fixing belt 411.

The upstream heat transfer portion 416A is located on the upstream side of the heater 413 in the direction in which the fixing belt 411 moves. In the present exemplary embodiment, the heat is transferred to the fixing belt 411 at a portion upstream of the heater 413.

The downstream heat transfer portion 416B is located on the downstream side of the heater 413 in the direction in which the fixing belt 411 moves. In the present exemplary embodiment, the heat is transferred to the fixing belt 411 at a portion downstream of the heater 413.

The upstream heat transfer portion 416A and the downstream heat transfer portion 416B are disposed in contact with the side surfaces 413C of the heater 413.

Each of the upstream heat transfer portion 416A and the downstream heat transfer portion 416B has an L-shaped section. More specifically, each of the upstream heat transfer portion 416A and the downstream heat transfer portion 416B has an L-shaped section taken along the plane perpendicular to the longitudinal direction of the heat transfer member 415 (axial direction of the pressing roller 46).

The upstream heat transfer portion 416A includes a first portion 91, which extends from the temperature-leveling portion 417 toward the fixing belt 411. The upstream heat transfer portion 416A also includes a second portion 92, which is continuous with the first portion 91.

The second portion 92, which is an example of a contact portion, linearly extends in the direction in which the fixing belt 411 moves. More specifically, the second portion 92 linearly extends upstream in the direction in which the fixing belt 411 moves. The second portion 92 is disposed along and in contact with the surface of the fixing belt 411 (inner peripheral surface 411A).

Here, in the present exemplary embodiment, the second portion 92 has a length L2 in the direction in which the fixing belt 411 moves, which is longer than a length L1 of the first portion 91 in the direction in which the fixing belt 411 moves.

The second portion 92 has a plate shape and extends along the inner peripheral surface 411A of the fixing belt 411. Thus, in the present exemplary embodiment, the second portion 92 is in surface contact with the fixing belt 411.

In the present exemplary embodiment, a contact surface 92A of the second portion 92 that comes into contact with the fixing belt 411 is flat. To be more specific, in the present exemplary embodiment, one of the surfaces of the plate-shaped second portion 92 is flat.

Here, the term "flat" does not necessarily mean that the contact surface 92A is thoroughly flat and includes the case where at least part of the contact surface 92A facing a sheet pass area, over which the sheet P passes, is flat.

The second portion 92 of the upstream heat transfer portion 416A has a plate shape. The second portion 92 linearly extends in a belt movement direction, which is the direction in which the fixing belt 411 moves, and also linearly extends in a direction crossing (perpendicular to) the belt movement direction (width direction of the fixing belt 411).

Thus, a portion of the second portion 92 facing the inner peripheral surface 411A of the fixing belt 411 is flat, and the second portion 92 is in surface contact with the fixing belt 411.

The contact surface 92A of the second portion 92 extends in a sheet movement direction, which is a direction in which the sheet P moves when passing through the nip portion N.

More specifically, when a sheet P passes through the nip portion N, the sheet P moves in a direction 2X in FIG. 2B. The contact surface 92A of the second portion 92 also extends in this direction 2X.

The contact surface 92A of the second portion 92 is disposed upstream of the contact-member facing surface 413A of the heater 413 in a sheet pass direction, in which the sheet P passes through the nip portion N. The contact surface 92A extends in the sheet pass direction.

The contact surface 92A of the second portion 92 is located in an imaginary plane 2Y, obtained by extending the contact-member facing surface 413A of the heater 413.

This structure allows a sheet P to move more smoothly than in the case where the contact surface 92A is not located in the imaginary plane 2Y.

When the contact surface 92A of the second portion 92 is located in the imaginary plane 2Y, bending of the fixing belt 411 is restricted, compared to the case where the contact surface 92A is not located in the imaginary plane 2Y. This structure also restricts bending of the sheet P, which hinders the sheet P from curling resulting from bending of the sheet P.

In the present exemplary embodiment, the second portion 92 is thinner than the temperature-leveling portion 417. Specifically, in the present exemplary embodiment, the temperature-leveling portion 417 has a thickness T1. The second portion 92 has a thickness T2, which is smaller than the thickness T1.

In this structure, the second portion 92 has smaller heat capacity than in the structure where the second portion 92 is thicker than the temperature-leveling portion 417. Thus, in the start-up time of the fixing device 40, the fixing belt 411 is less likely to have its heat taken by the second portion 92.

If the second portion 92 is thick and has large heat capacity, the fixing belt 411 immediately after the heater 413 is turned on would be more likely to have its heat taken by the second portion 92 and would be less likely to have its temperature raised.

On the other hand, as in the present exemplary embodiment, when the second portion 92 is thin and has small heat capacity, the fixing belt 411 is less likely to have its heat taken by the second portion 92 and is more likely to have its temperature raised.

Now, the downstream heat transfer portion 416B is described.

The downstream heat transfer portion 416B has a structure similar to that of the upstream heat transfer portion 416A. The downstream heat transfer portion 416B includes a first portion 93, which extends from the temperature-leveling portion 417 toward the fixing belt 411. The downstream heat transfer portion 416B also includes a plate-shaped second portion 94, which is continuous with the first portion 93.

The second portion 94 linearly extends downstream in the direction in which the fixing belt 411 moves and in the width direction of the fixing belt 411. The second portion 94 is in contact with the inner peripheral surface 411A of the fixing belt 411.

As in the case of the upstream heat transfer portion 416A, also in the downstream heat transfer portion 416B, the second portion 94 is longer than the first portion 93 in the direction in which the fixing belt 411 moves. Also in the downstream heat transfer portion 416B, the second portion 94 is thinner than the temperature-leveling portion 417.

Also in the downstream heat transfer portion 416B, a contact surface 94A of the second portion 94 that comes into contact with the fixing belt 411 is flat.

In the upstream heat transfer portion 416A and the downstream heat transfer portion 416B according to the present exemplary embodiment, the flat contact surfaces 92A and 94A that come into contact with the fixing belt 411 increase the length of the nip portion N (see FIG. 2A) and thus increase the quantity of heat supplied to the sheet P.

The flat contact surfaces 92A and 94A that come into contact with the fixing belt 411 also hinder the sheet P from being curled.

Figure 5:
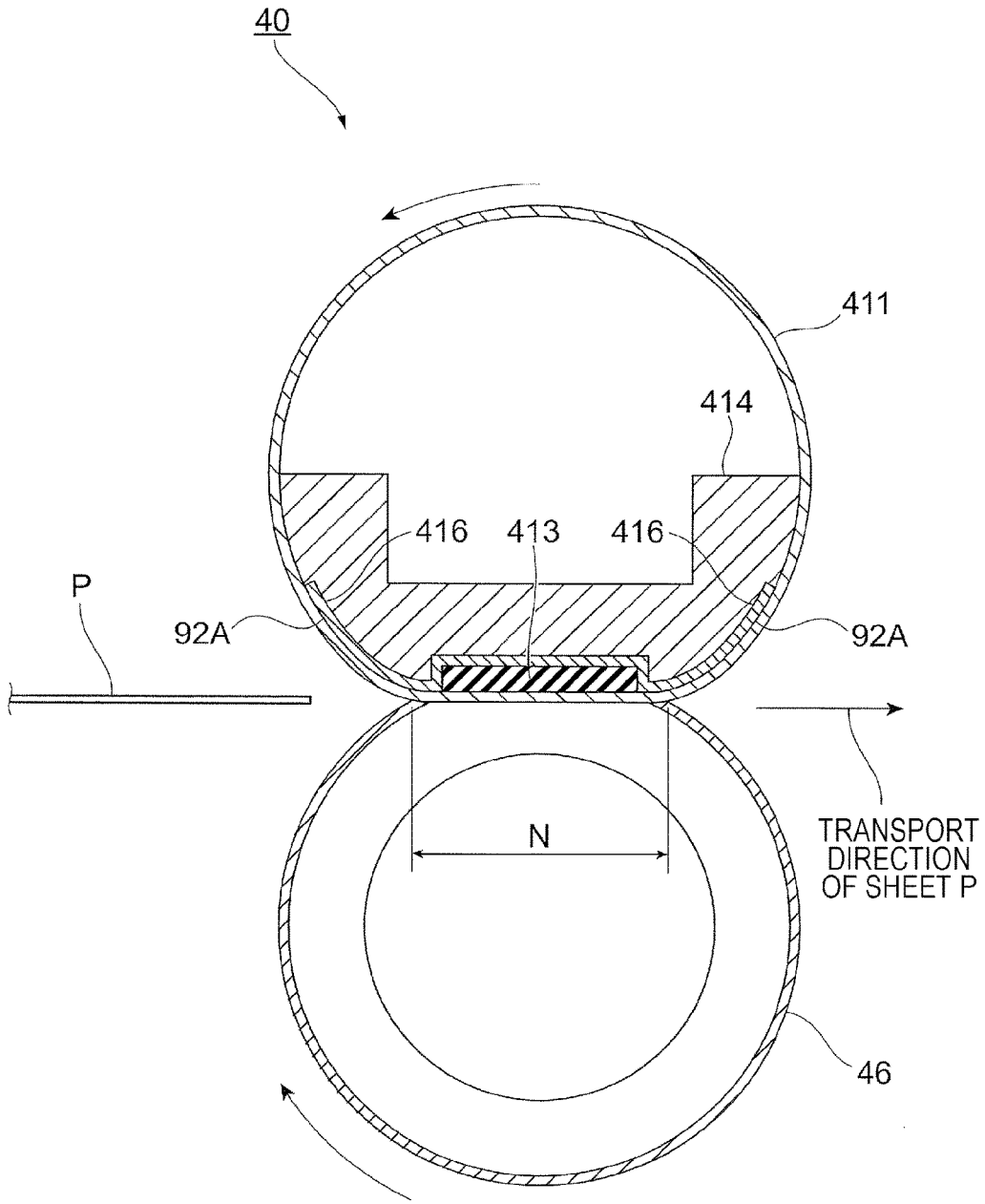
FIG. 5 illustrates a comparative example of a fixing device.

FIG. 5 illustrates a comparative example of the fixing device 40.

In the comparative example, each of the heat transfer portions 416 has a curved contact surface 92A, which comes into contact with the fixing belt 411. In other words, the comparative example also includes the heat transfer portions 416 that transfer heat to the fixing belt 411, but the contact surface 92A of each heat transfer portion 416 that comes into contact with the fixing belt 411 is curved.

In this case, the fixing belt 411 is shaped along the curved surface and bent away from the pressing roller 46. Thus, the nip portion N becomes shorter.

In this comparative example, the sheet P is more likely to come into contact with the bent fixing belt 411 at portions upstream or downstream of the nip portion N. In this case, the sheet P is more likely to be shaped along the fixing belt 411 and more likely to be curled.

Particularly, in this comparative example, heat from the heat transfer portions 416 is supplied to the bent portions of the fixing belt 411. This structure thus allows the sheet P to be more likely to be curled than in the case where the sheet P comes into contact with portions to which heat is not supplied.

On the other hand, as in the present exemplary embodiment, the flat contact surfaces 92A and 94A of the heat transfer portions 416 (the upstream heat transfer portion 416A and the downstream heat transfer portion 416B) reduce bending of the fixing belt 411 and facilitates contact of the sheet P with a flat portion of the fixing belt 411. This structure thus reduces curling of the sheet P.

In the present exemplary embodiment, as illustrated in FIG. 2B, the pressing roller 46 is pressed against the flat contact surfaces 92A and 94A with the fixing belt 411 interposed therebetween. In other words, in the present exemplary embodiment, the fixing belt 411 is urged toward the heat transfer portions 416 by the pressing roller 46 and the urged fixing belt 411 is pressed against the heat transfer portions 416.

This structure enhances the contact pressure between the heat transfer portions 416 and the fixing belt 411 compared to the structure in which the fixing belt 411 and the pressing roller 46 are not pressed against the heat transfer portions 416. This structure thus facilitates transfer of heat of the heat transfer portions 416 to the fixing belt 411.

In the present exemplary embodiment, heat is transferred from the contact surfaces 92A and 94A to the fixing belt 411 through a portion of the fixing belt 411 located in the nip portion N (hereinafter referred to as "a nip inner portion").

In other words, each of the heat transfer portions 416 according to the present exemplary embodiment extends from the inner side of the fixing belt 411 toward the nip inner portion. Each heat transfer portion 416 comes into contact with the nip inner portion of the fixing belt 411.

The nip portion N of the fixing belt 411 is more likely to have its heat taken by the sheet P and is more likely to have its temperature lowered.

Here, heat transfer to the nip inner portion of the fixing belt 411 would raise the temperature of the fixing belt 411 in the nip portion N, compared to the case where heat is transferred to a portion of the fixing belt 411 other than the nip inner portion.

Preferable heat transfer to the nip inner portion is to transfer heat to a portion of the nip inner portion located upstream in the direction in which the sheet P is transported (upstream in a direction in which the sheet P passes through the nip portion N).

More specifically, preferable heat transfer to the nip inner portion is to transfer heat to a portion of the nip inner portion on the left side of a line 2H in FIG. 2B (line indicating the middle portion of the nip portion N).

In this case, heat is supplied to an upstream portion of the nip inner portion. The fixing belt 411 has its temperature raised over a wider area of the nip inner portion than in the case where heat is supplied to a downstream portion of the nip inner portion.

Figure 6A:
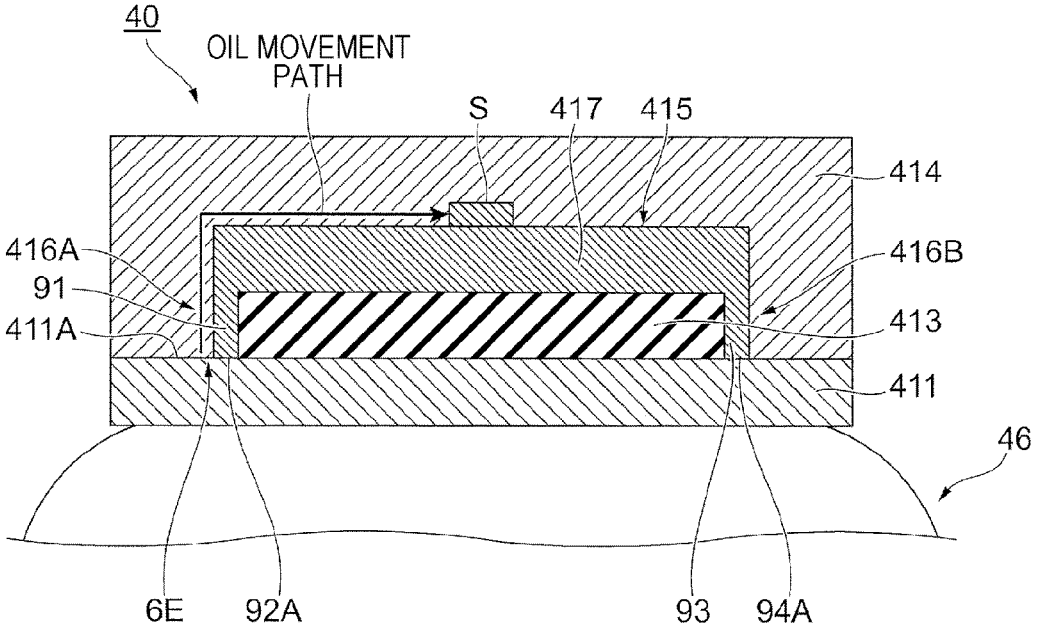
FIGS. 6A and 6B illustrate other structure examples of a fixing device.
Figure 6B:
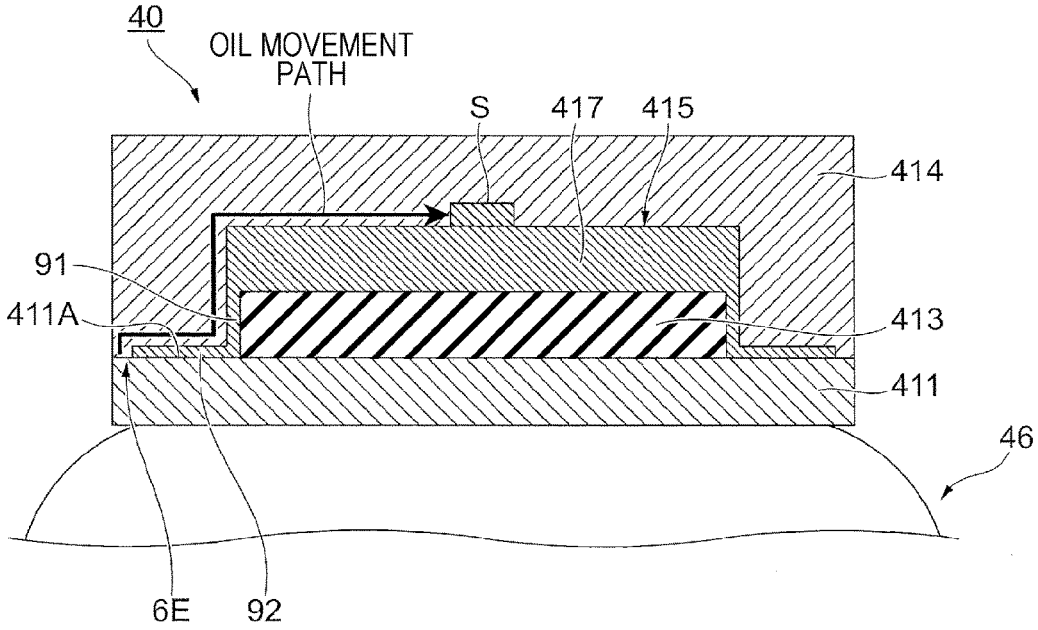

FIGS. 6A and 6B illustrate other structure examples of the fixing device 40. FIG. 6 illustrates the heater 413, the heat transfer member 415, the support member 414, the fixing belt 411, and the pressing roller 46 of the fixing device 40.

As illustrated in FIG. 6A, the heat transfer member 415 may have a shape different from that illustrated in FIGS. 2A, 2B, 2C and other drawings.

The structure example illustrated in FIG. 6A does not include portions corresponding to the second portions 92 and 94 illustrated in FIGS. 2A, 2B, and 2C. The upstream heat transfer portion 416A only has the first portion 91, and the downstream heat transfer portion 416B only has the first portion 93. Such a structure example is also capable of transferring heat from the temperature-leveling portion 417 to the fixing belt 411.

Also in this structure example, the first portion 91 has a flat contact surface 92A that comes into contact with the fixing belt 411, and the first portion 93 has a flat contact surface 94A that comes into contact with the fixing belt 411.

In terms of inaccessibility of the lubricant to the temperature sensor S, the structure example illustrated in FIGS. 2A, 2B, and 2C is more preferable than the structure example illustrated in FIG. 6A.

In the fixing device 40 according to the present exemplary embodiment, a lubricant is applied to the inner peripheral surface 411A of the fixing belt 411. The lubricant may reach the temperature sensor S through a space between the support member 414 and the heat transfer member 415, which may degrade the temperature measurement accuracy.

Compared to the structure example illustrated in FIG. 6A, the structure example illustrated in FIGS. 2A, 2B, and 2C hinders the lubricant from reaching the temperature sensor S and is less likely to degrade the temperature measurement accuracy.

FIG. 6B illustrates a flow of the lubricant in the structure example illustrated in FIGS. 2A, 2B, and 2C.

When the lubricant on the inner peripheral surface 411A of the fixing belt 411 reaches the heat transfer member 415, the lubricant may pass through an inlet portion 6E and enter the space between the support member 414 and the heat transfer member 415.

The lubricant may then reach the temperature sensor S through the space between the support member 414 and the heat transfer member 415.

When the second portion 92 is disposed in addition to the first portion 91, a path for the lubricant to move from the inlet portion 6E to the temperature sensor S is elongated, which hinders the lubricant from reaching the temperature sensor S.

On the other hand, in the structure example illustrated in FIG. 6A (in the structure example that does not include the second portion 92), the path for the lubricant to move from the inlet portion 6E to the temperature sensor S is shorter, which allows the lubricant to more easily reach the temperature sensor S than in the case of the structure example illustrated in FIG. 6B.

FIG. 7A to 7D illustrate other structure examples of the fixing device 40. FIGS. 7A to 7D illustrate the heater 413, the heat transfer member 415, the support member 414, and the fixing belt 411 of the fixing device 40.

Figure 7A:
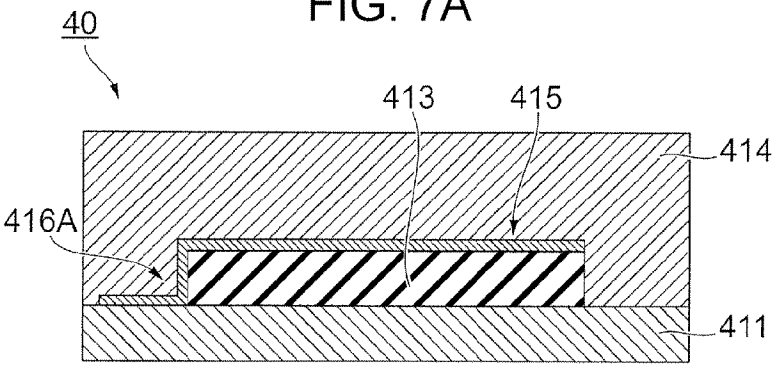
FIGS. 7A to 7D illustrate other structure examples of a fixing device.

The structure example illustrated in FIG. 7A does not include the downstream heat transfer portion 416B and only includes the upstream heat transfer portion 416A.

The structure example illustrated in FIGS. 2A, 2B, and 2C includes two heat transfer portions 416, that is, the upstream heat transfer portion 416A and the downstream heat transfer portion 416B. However, the number of the heat transfer portions 416 is not limited to two and may be one, as illustrated in FIG. 7A.

The single heat transfer portion 416 does not have to be the upstream heat transfer portion 416A and may be the downstream heat transfer portion 416B.

Between the upstream heat transfer portion 416A and the downstream heat transfer portion 416B, the upstream heat transfer portion 416A is preferable as the single heat transfer portion 416.

As described above, the upstream heat transfer portion 416A feeds heat to an upstream portion of the nip inner portion. This structure allows heat to be supplied to a wider area of the nip inner portion than in the structure that includes only the downstream heat transfer portion 416B.

Figure 7B:
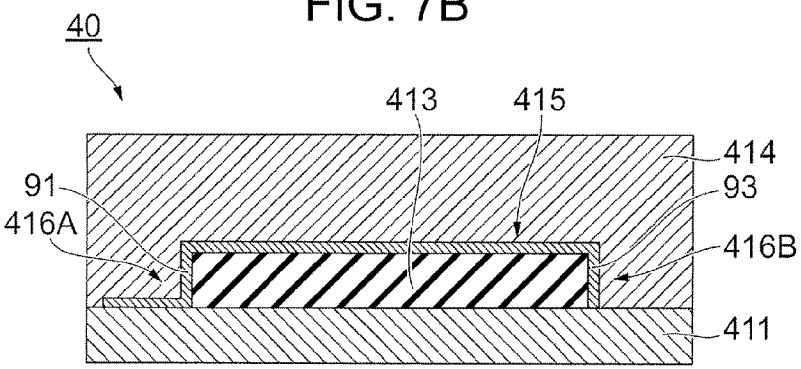

FIG. 7B illustrates the structure example in which the downstream heat transfer portion 416B does not include the second portion 94 and only includes the first portion 93 that comes into contact with the fixing belt 411.

In other words, in this structure example, the contact area between the fixing belt 411 and the upstream heat transfer portion 416A is greater than the contact area between the fixing belt 411 and the downstream heat transfer portion 416B, so that a larger quantity of heat is transferred to the fixing belt 411 at the upstream portion.

In terms of reduction of misalignment between the heat transfer member 415 and the heater 413 (misalignment in the direction in which the fixing belt 411 moves), the structure illustrated in FIG. 7B is more preferable than the structure illustrated in FIG. 7A.

In other words, rather than the structure that does not include the downstream heat transfer portion 416B, the structure including the downstream heat transfer portion 416B at least including the first portion 93 is preferable.

In the structure in which the downstream heat transfer portion 416B includes the first portion 93, as illustrated in FIG. 7B, the heater 413 is located between the first portion 91 of the upstream heat transfer portion 416A and the first portion 93 of the downstream heat transfer portion 416B.

Also in this case, a movement of the heater 413 in the lateral direction in the drawing is more likely to be restricted by the two first portions (first portions 91 and 93). This structure thus hinders the heater 413 and the heat transfer member 415 from being misaligned with each other.

Figure 7C:
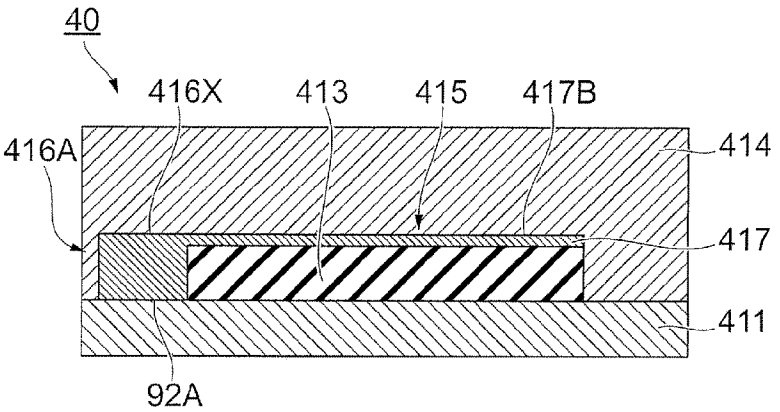

FIG. 7C illustrates another structure example of the fixing device 40.

Similarly to the above structure example of FIG. 7A, this structure example does not include the downstream heat transfer portion 416B. Also in this structure example, the upstream heat transfer portion 416A has a shape different from that illustrated in FIGS. 2A, 2B, 2C, and other drawings.

Specifically, in the structure example illustrated in FIGS. 2A, 2B, and 2C, each of the upstream heat transfer portion 416A and the downstream heat transfer portion 416B has an L-shaped section. In the structure example illustrated in FIG. 7C, on the other hand, the upstream heat transfer portion 416A has a rectangular section.

More specifically, in the structure example illustrated in FIG. 7C, an upper surface 416X of the upstream heat transfer portion 416A (surface opposite to the contact surface 92A that comes into contact with the fixing belt 411) is located on the extension line of the back surface 417B of the temperature-leveling portion 417.

In other words, in the thickness direction of the fixing belt 411, the position of the back surface 417B of the temperature-leveling portion 417 and the position of the upper surface 416X of the upstream heat transfer portion 416A are aligned with each other.

In the structure example illustrated in FIG. 7C, the heat transfer member 415 is more easily processible (cutting process required to manufacture the heat transfer member 415 is further simplified), so that the heat transfer member 415 is capable of being more easily manufactured.

In the structure example illustrated in FIG. 7C, the upstream heat transfer portion 416A has a rectangular section. Instead, the structure example may have a downstream heat transfer portion 416B having a rectangular section.

Alternatively, the upstream heat transfer portion 416A and the downstream heat transfer portion 416B may have a rectangular section.

Figure 7D:
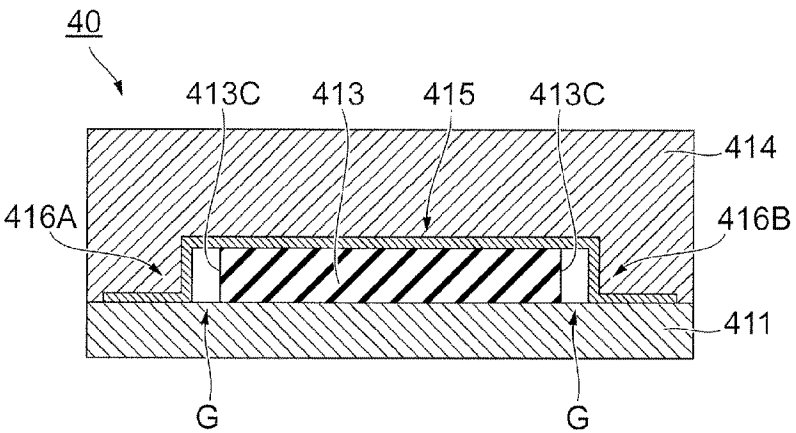

The structure example illustrated in FIG. 7D has a gap G between the side surface 413C of the heater 413 and the upstream heat transfer portion 416A, and a gap G between the side surface 413C of the heater 413 and the downstream heat transfer portion 416B.

Each of the upstream heat transfer portion 416A and the downstream heat transfer portion 416B may be in contact with the side surfaces 413C of the heater 413 as illustrated in FIGS. 2A, 2B, and 2C. Instead, as illustrated in FIG. 7D, a gap G may be disposed between the upstream heat transfer portion 416A and the heater 413 or between the downstream heat transfer portion 416B and the heater 413.

The structure example illustrated in FIG. 7D has two gaps G corresponding to the upstream heat transfer portion 416A and the downstream heat transfer portion 416B. Instead, one of the upstream heat transfer portion 416A and the downstream heat transfer portion 416B may be brought into contact with the side surface 413C of the heater 413, and the other may be spaced apart from the side surface 413C of the heater 413.

In terms of transfer of as much heat as possible to the fixing belt 411, at least one of the upstream heat transfer portion 416A and the downstream heat transfer portion 416B is preferably brought into contact with the side surface 413C of the heater 413.

This structure allows more heat of the heater 413 to be recovered by the upstream heat transfer portion 416A and/or the downstream heat transfer portion 416B, and allows a larger quantity of heat to be supplied to the fixing belt 411, than in the case of the structure including the two gaps G.

Figure 8:
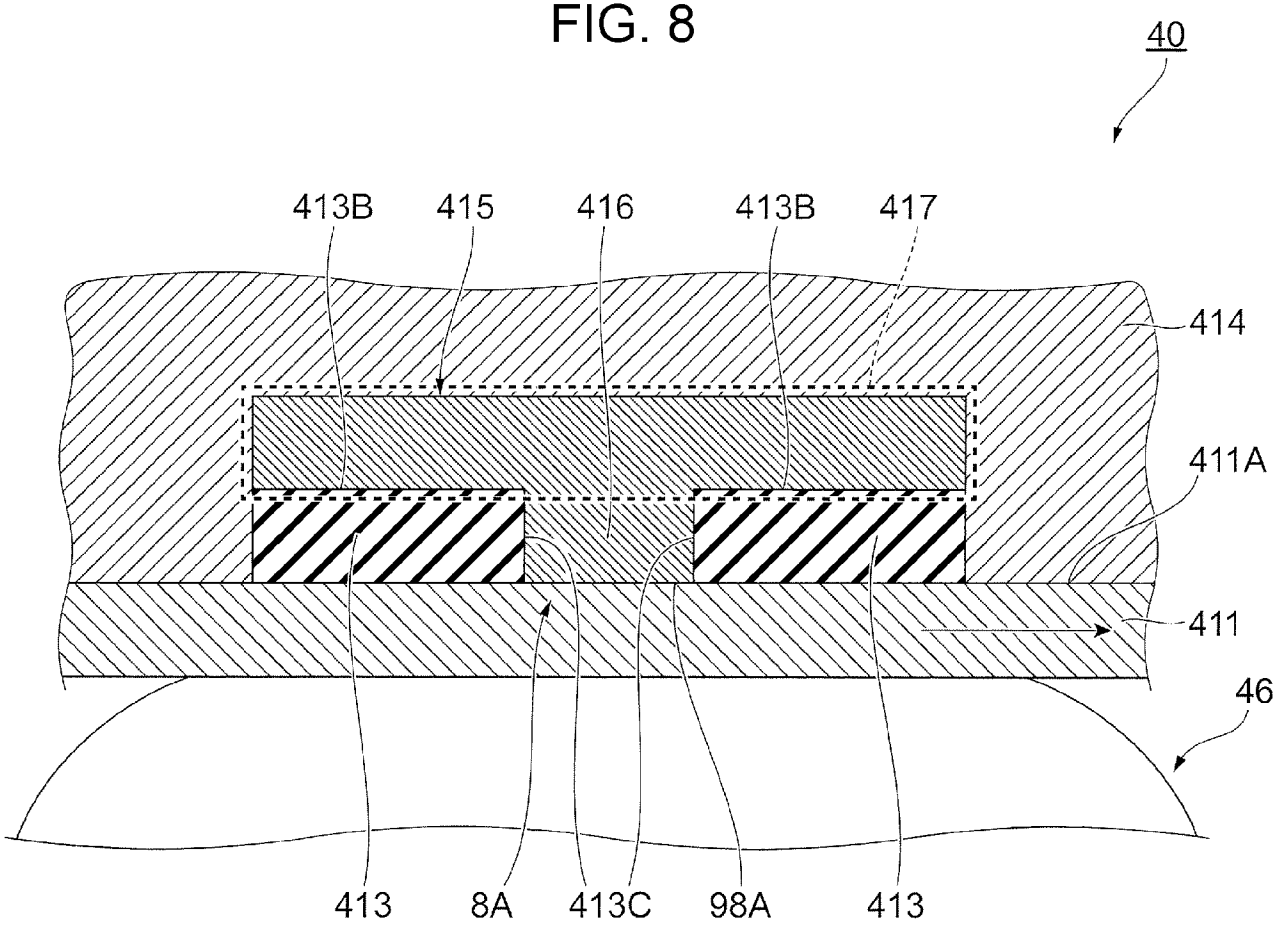
FIG. 8 illustrates another structure example of a fixing device.

FIG. 8 illustrates another structure example of the fixing device 40.

This structure example includes multiple heaters 413.

The multiple heaters 413 are arranged at different positions in the direction in which the fixing belt 411 moves. This structure example has a gap 8A between adjacent two of the heaters 413.

This structure example includes a heat transfer member 415 having a T-shaped section.

This heat transfer member 415 also includes the temperature-leveling portion 417, which is disposed in contact with the back surface 413B of each heater 413, and the heat transfer portion 416, which extends from the temperature-leveling portion 417 toward the fixing belt 411.

The heat transfer portion 416 extends through the gap 8A to the fixing belt 411 and comes into contact with the inner peripheral surface 411A of the fixing belt 411 at the tip end of the heat transfer portion 416.

Also in this structure example, a contact surface 98A of the heat transfer portion 416 that comes into contact with the fixing belt 411 is flat.

The heat transfer portion 416 is disposed so as to be in contact with the side surfaces 413C of the adjacent heaters 413.

Each of the above-described structure examples includes the heat transfer portion or portions 416 at the portion or portions upstream and/or downstream of the heater 413. However, as in the case of this structure example, heat may be supplied to the fixing belt 411 between the heaters 413.

Figure 9:
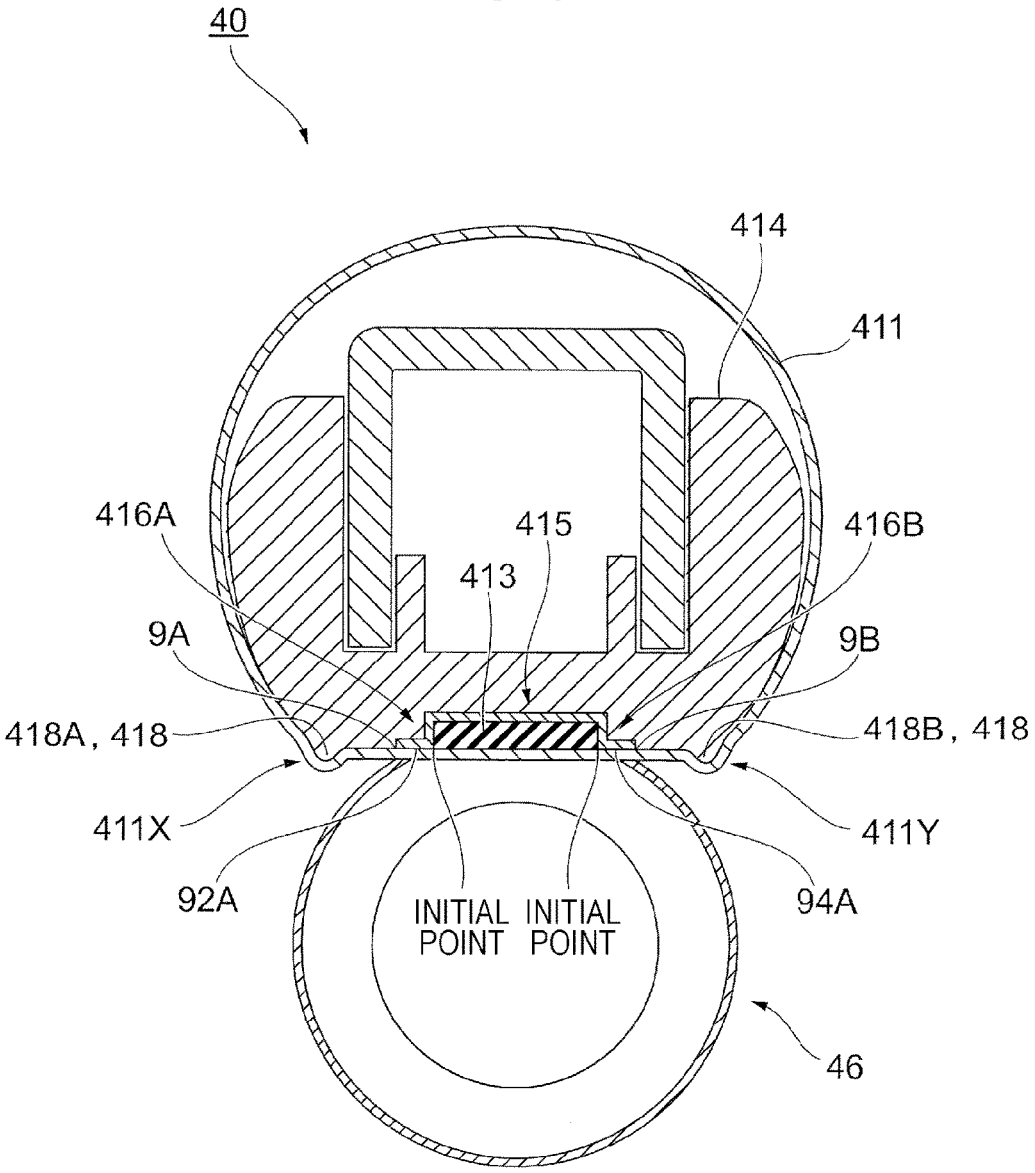
FIG. 9 illustrates another structure example of a fixing device.

FIG. 9 illustrates another structure example of the fixing device 40.

This structure example includes two protrusions 418 in the support member 414. Specifically, in the movement direction of the sheet P, an upstream protrusion 418A is disposed upstream of the heater 413, and a downstream protrusion 418B is disposed downstream of the heater 413.

The upstream protrusion 418A and the downstream protrusion 418B press the fixing belt 411 from the side on which the heater 413 and the heat transfer member 415 are disposed to respectively form an upstream bent portion 411X and a downstream bent portion 411Y in the fixing belt 411.

In other words, the upstream protrusion 418A and the downstream protrusion 418B press the fixing belt 411 from a first side of the fixing belt 411 to form the upstream bent portion 411X and the downstream bent portion 411Y in the fixing belt 411.

Here, the two protrusions 418 do not necessarily have to be provided. Only one of the protrusions 418 may be disposed upstream or downstream of the heater 413.

When the upstream protrusion 418A is provided, the fixing belt 411 is disposed at a portion closer to the pressing roller 46 than in the case where the upstream protrusion 418A is not provided, so that the fixing belt 411 and the sheet P are more likely to come into contact with each other.

In this case, the contact length between the sheet P and the fixing belt 411 when the sheet P passes through the fixing device 40 is elongated, so that more heat is supplied to the sheet P.

When the downstream protrusion 418B is provided, the downstream protrusion 418B causes the fixing belt 411 and the sheet P to diverge in different movement directions so that the sheet P is more likely to be separated from the fixing belt 411.

Similarly to the above structure example, in this structure example, the upstream heat transfer portion 416A includes a contact surface 92A (hereinafter referred to as "an upstream contact surface 92A") that comes into contact with the fixing belt 411.

In addition, the downstream heat transfer portion 416B includes a contact surface 94A (hereinafter referred to as "a downstream contact surface 94A") that comes into contact with the fixing belt 411.

Here, the upstream contact surface 92A and the downstream contact surface 94A are flat, as in the above-described surfaces.

The upstream contact surface 92A extends from an initial point located between the heater 413 and the upstream bent portion 411X toward the upstream bent portion 411X. In this structure example, an end 9A of the upstream contact surface 92A at a downstream portion in a direction in which the upstream contact surface 92A extends is located in front of the upstream bent portion 411X.

The downstream contact surface 94A extends from an initial point located between the heater 413 and downstream bent portion 411Y toward the downstream bent portion 411Y. In this structure example, an end 9B of the downstream contact surface 94A at a downstream portion in a direction in which the downstream contact surface 94A extends is located in front of the downstream bent portion 411Y.

If the upstream contact surface 92A reaches the upstream bent portion 411X, or the downstream contact surface 94A reaches the downstream bent portion 411Y, the upstream bent portion 411X or the downstream bent portion 411Y would have its temperature raised.

In this case, the sheet P would be more likely to be curled when passing by the upstream bent portion 411X or the downstream bent portion 411Y.

Specifically, the upstream bent portion 411X and the downstream bent portion 411Y are bent, so that the sheet P is more likely to be curled if it comes into contact with the upstream bent portion 411X or the downstream bent portion 411Y.

In this case, if the upstream contact surface 92A reaches the upstream bent portion 411X or the downstream contact surface 94A reaches the downstream bent portion 411Y, the upstream bent portion 411X or the downstream bent portion 411Y would be more likely to have its temperature raised, so that the sheet P would be curled to a larger extent.

On the other hand, as in the present exemplary embodiment in which the upstream contact surface 92A does not reach the upstream bent portion 411X or the downstream contact surface 94A does not reach the downstream bent portion 411Y, the upstream bent portion 411X or the downstream bent portion 411Y is prevented from having its temperature raised, so that curling of the sheet P, even if produced, would be kept small.

EXAMPLES

Figure 10:
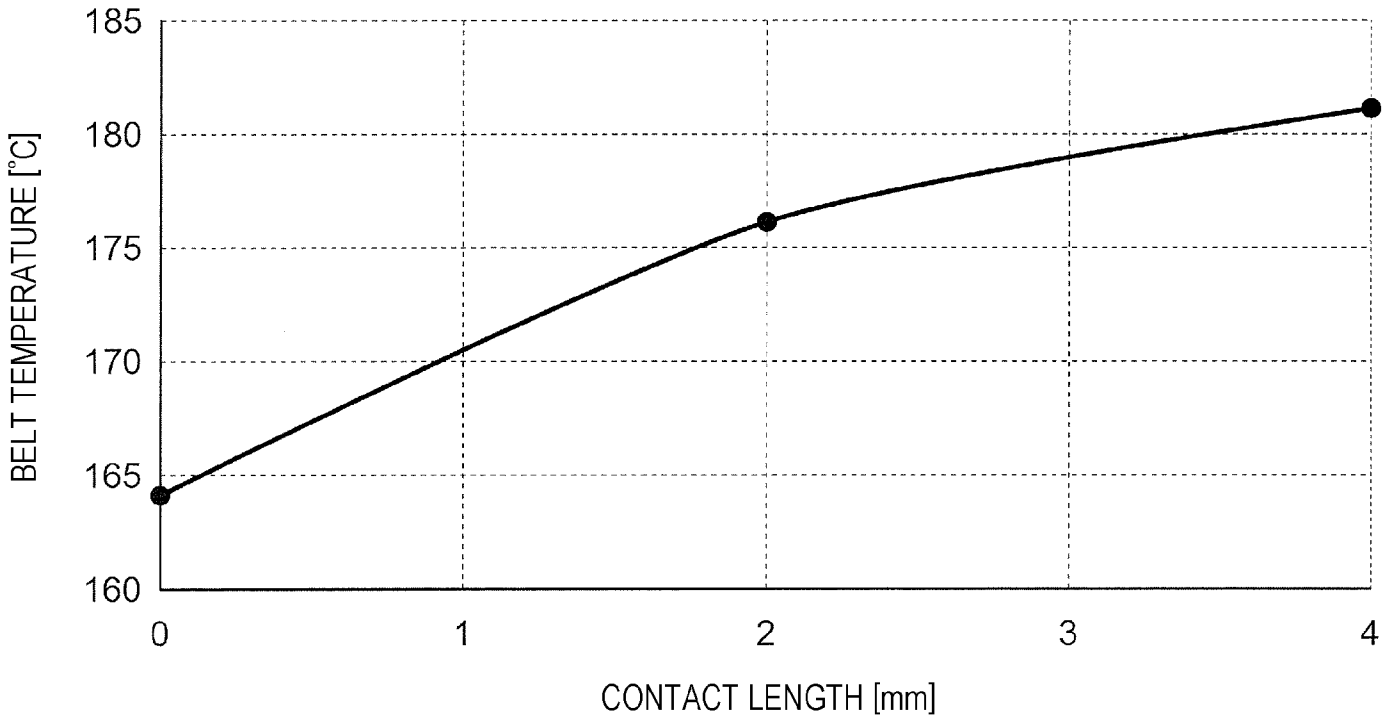
FIG. 10 is a graph showing the results of a simulation.

FIG. 10 is a graph showing the simulation results.

Through the simulation, the temperature of the fixing belt 411 of the fixing device 40 illustrated in FIGS. 2A, 2B, and 2C is observed. Specifically, the change in the temperature of the fixing belt 411 caused by the difference in contact length between the heat transfer portions 416 and the fixing belt 411 is observed through the simulation.

Specifically, the temperature of the heater 413 is fixed at 230° and the contact length between the heat transfer portions 416 and the fixing belt 411 is changed to observe the temperature of the fixing belt 411.

Here, "the contact length" in this simulation is the length in the direction in which the fixing belt 411 moves, which is the sum of the contact length by which the upstream heat transfer portion 416A comes into contact with the fixing belt 411 and the contact length by which the downstream heat transfer portion 416B comes into contact with the fixing belt 411.

As illustrated in FIG. 10, the simulation results show that the quantity of heat that transfers from the heat transfer member 415 to the fixing belt 411 increases as the contact length increases, and the temperature of the fixing belt 411 rises as the contact length increases.

In FIG. 10, the contact length "zero" represents the state where no heat transfer portion 416 is disposed and the heat transfer member 415 does not come into contact with the fixing belt 411.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device, comprising:

a contact member that comes into contact with a recording medium on which an image is formed;

a heater that has a contact-member facing surface, which faces the contact member, and a back surface, the heater heating the contact member;

a heat supply member disposed in contact with the back surface of the heater, and supplying heat of a portion of the heater having a high temperature to a portion of the heater having a low temperature; and a heat transfer portion disposed in contact with the contact member, and having a flat contact surface that comes into contact with the contact member, the heat transfer portion not having a curved contact surface that comes into contact with the contact member, the heat transfer portion transferring heat of the heat supply member to the contact member.

2. The fixing device according to claim 1, further comprising:

a pressing member disposed in contact with the contact member, and pressing the recording medium that passes between the pressing member and the contact member, wherein the pressing member is pressed against the flat contact surface of the heat transfer portion with the contact member interposed therebetween.

3. The fixing device according to claim 1, further comprising:

a pressing member disposed in contact with the contact member and forming a pressing area, over which the recording medium passes while being pressed, between the pressing member and the contact member, wherein heat is transferred from the flat contact surface of the heat transfer portion to a portion of the contact member located in the pressing area.

4. The fixing device according to claim 3, wherein heat is transferred to an area of the portion of the contact member located in the pressing area, the area of the portion being located upstream a direction in which the recording medium passes.

5. The fixing device according to claim 1, wherein the heater has a side surface that connects the contact-member facing surface and the back surface to each other, and wherein the heat transfer portion is disposed in contact with the side surface of the heater.

6. The fixing device according to claim 1, further comprising:

a pressing member pressed against the contact-member facing surface of the heater with the contact member interposed therebetween, and forming a pressing area, over which the recording medium passes while being pressed, between the pressing member and the contact member, wherein, when the recording medium passes over the pressing area, the recording medium moves along a predetermined direction, and wherein the flat contact surface of the heat transfer portion is disposed on at least one of an upstream side and a downstream side of the contact-member facing surface of the heater in a recording medium movement direction in which the recording medium passes over the pressing area, and the flat contact surface extends in the predetermined direction.

7. The fixing device according to claim 6, wherein the flat contact surface of the heat transfer portion is located in an imaginary plane obtained by extending the contact-member facing surface of the heater.

8. The fixing device according to claim 1, wherein the contact member is movable, and wherein the heat transfer portion includes a first portion and a second portion, the first portion extends from the heat supply member toward the contact member, and the second portion is connected to the first portion, linearly extends in a movement direction of the contact member, and is disposed in contact with the contact member.

9. The fixing device according to claim 8, wherein the second portion has a length in the movement direction of the contact member that is longer than a length of the first portion in the movement direction.

10. The fixing device according to claim 1, wherein the heater is provided in a plurality and each adjacent pair of the plurality of heaters are spaced by a gap, and wherein the heat transfer portion extends through the gap toward the contact member.

11. The fixing device according to claim 10, wherein each of the heaters has a side surface that connects the contact-member facing surface and the back surface to each other, and wherein the heat transfer portion is disposed in contact with the side surfaces of the adjacent heater pair.

12. An image forming apparatus, comprising:

an image forming device that forms an image on a recording medium; and a fixing device that fixes the image formed on the recording medium by the image forming device to the recording medium, wherein the fixing device is the fixing device according to claim 1.

13. A fixing device, comprising:

a contact member that comes into contact with a recording medium on which an image is formed;

a heater that has a contact-member facing surface, which faces the contact member, and a back surface, the heater heating the contact member;

a heat supply member disposed in contact with the back surface of the heater, and supplying heat of a portion of the heater having a high temperature to a portion of the heater having a low temperature; and a heat transfer portion disposed in contact with the contact member, and having a flat contact surface that comes into contact with the contact member, the heat transfer portion transferring heat of the heat supply member to the contact member, wherein the heat supply member has a plate shape and is disposed in contact with and along the back surface of the heater, wherein the heat transfer portion includes a plate-shaped contact portion that comes into contact with the contact member, the contact portion is disposed along a surface of the contact member, and the plate-shaped contact portion has a flat surface, and wherein the contact portion of the heat transfer portion has a smaller thickness than the heat supply member.

14. A fixing device, comprising:

a contact member that comes into contact with a recording medium on which an mage is formed;

a heater that has a contact-member facing surface, which faces the contact member, and a back surface, the heater heating the contact member;

a heat supply member disposed in contact with the back surface of the heater, and supplying heat of a portion of the heater having a high temperature to a portion of the heater having a low temperature;

a heat transfer portion disposed in contact with the contact member, and having a flat contact surface that comes into contact with the contact member, the heat transfer portion transferring heat of the heat supply member to the contact member; and a protrusion disposed on at least one of an upstream side and a downstream side of the heater in a movement direction of the recording medium, the protrusion pressing the contact member from one side of the contact member to form a bent portion in the contact member, wherein the flat contact surface of the heat transfer portion extends toward the bent portion from an initial point located between the heater and the bent portion to an end, the end being located downstream in a direction in which the flat contact surface extends and at a portion in front of the bent portion.

* * * * *